United States Patent [19]

Russ

[11] Patent Number: 4,459,969

[45] Date of Patent: Jul. 17, 1984

[54] OVERHEAD RADIUS DRESSER FOR GRINDING WHEELS

[76] Inventor: Edwin Russ, 985 Badder, Troy, Mich. 48084

[21] Appl. No.: 339,267

[22] Filed: Jan. 15, 1982

[51] Int. Cl.[3] ..... B24B 53/06

[52] U.S. Cl. ..... 125/11 AT

[58] Field of Search ..... 125/11 R, 11 AT, 11 A

[56] References Cited

U.S. PATENT DOCUMENTS

| | | | |
|---|---|---|---|
| 1,994,386 | 3/1935 | Dardani | 125/11 AT |
| 2,336,758 | 12/1943 | Statia . | |
| 2,404,148 | 7/1946 | Thompson | 125/11 AT |
| 2,404,465 | 7/1946 | Statia . | |
| 2,585,305 | 2/1952 | Fritts | 125/11 AT |
| 2,608,189 | 8/1952 | Statia . | |
| 2,642,856 | 6/1953 | Calloway | 125/11 AT |
| 2,794,433 | 6/1957 | Shanley . | |
| 2,804,868 | 9/1957 | Coup . | |
| 2,815,017 | 12/1957 | Bordonaro . | |
| 2,882,887 | 4/1959 | Campbell . | |
| 3,006,331 | 10/1961 | Akert . | |
| 3,028,853 | 4/1962 | Miller . | |
| 3,532,084 | 3/1968 | Swenson | 125/11 AT |
| 3,552,374 | 1/1971 | Knuff | 125/11 AT |
| 3,576,184 | 4/1971 | Nichols . | |
| 3,623,469 | 11/1971 | Niles . | |
| 3,685,505 | 8/1972 | Rohrle | 125/11 AT |
| 3,855,992 | 12/1974 | Nordin . | |
| 3,888,230 | 6/1975 | Foshee . | |
| 4,006,727 | 2/1977 | Hancock . | |
| 4,071,015 | 1/1978 | Funke . | |
| 4,180,046 | 12/1979 | Kerner . | |
| 4,198,950 | 4/1980 | Van DeMotter . | |

FOREIGN PATENT DOCUMENTS

| | | | |
|---|---|---|---|
| 492549 | 9/1938 | United Kingdom | 125/11 AT |
| 1215809 | 12/1970 | United Kingdom | 125/11 AT |

*Primary Examiner*—Harold D. Whitehead

*Attorney, Agent, or Firm*—Cullen, Sloman, Cantor, Grauer, Scott & Rutherford

[57] ABSTRACT

An overhead radius dresser for grinding wheels for surface grinders has a housing mounted upon the wheel spindle supporting a reciprocally rotatable main shaft mounting a slide having a central axis coincident with the grinding wheel plane. A slide housing is mounted upon the slide plate and adapted for movements upon a transverse axis. A radially adjustable slide arm depends from the slide housing for determining the radius of dressing the grinding wheel, and supports a depending diamond holder arm mounting a diamond tool which on selective rotation of the main shaft in opposite directions from a central position causes the tool to dress the grinding wheel radius in either direction and successively on additional transverse movement of the slide housing until stopped causes the diamond tool to sweep tangentially over the respective outer angle portions of the grinding wheel. Stop screw means including a pair of reciprocally movable pins is mounted upon and is interposed between the slide plate and the slide housing to facilitate stopping at the centerline and for tangential surface dressing of the tangential angles of the grinding wheel.

6 Claims, 9 Drawing Figures

OVERHEAD RADIUS DRESSER FOR GRINDING WHEELS

BACKGROUND OF THE INVENTION

Heretofore in the art, the grinding wheel for surface grinders or the like after continued use requires dressing of the radius, and in some cases requires dressing of the outer tangential angled surfaces of the grinding wheel.

In the prior art there have been considerable efforts in providing radius dressers for a grinding wheel, but only limited effort in providing a dresser which is also capable of forming accurate tangential dressing of the outer angles connected to the radius of the grinding wheel being dressed.

SUMMARY OF THE INVENTION

A feature of the present invention is to provide an overhead radius dresser which is mountable upon the spindle of a surface grinder in order to support a diamond dressing tool which is adapted to reciprocally sweep from a central portion to the opposite sides of a grinding wheel radius.

A further feature is to incorporate within the support mechanism for the diamond tool, a slide housing which is adapted for successive transverse movement along the axis of the grinding wheel defining a rectilinear reciprocal movement for the diamond tool for dressing tangential angles on the grinding wheel upon its opposite sides.

A further feature is to provide a control mechanism guiding the transverse successive sweep movements of the dressing tool in rectilinear angular directions so as to move tangentially from the outer border of the radius and along the adjacent outer angles respectively of the grinding wheel and to the outer edges thereof.

A further feature includes the use of telescoping stop pins which may be employed for centerline holding limiting the diamond tool for dressing the radius only or which may be employed to serve the further function of controlling the stopping point, with a transversely movable diamond holder slide dressing tangentially over the outer angles respectively of the grinding wheel. This stopping of the transverse movement of the diamond tool is accomplished by the use of a pair of opposed telescoping tangent pins.

A feature therefore of the present invention is that the radius dresser dresses a radius on the grinding wheel tangent to the two angles thereon. The dresser is adapted to dress a wide angle across the entire wheel.

A further feature incorporates the use of accurately preset stops for limiting the manual rotary movement of the main shaft to which a dressing tool is connected for simultaneously limiting the extent of the rotary arc of the diamond tool in opposite directions from a central position dressing the radius on a grinding wheel.

A further feature of the present overhead dresser is that centerline holds may be employed for the diamond tool, so that the diamond tool is maintained during such dressing operation in registry with the centerline of the grinding wheel plane.

The present overhead dresser has provision for radial adjustment of the diamond tool upon opposite sides of its axis of rotation for selectively dressing the general radius of the grinding wheel whether it be concave or convex.

These and other features will be seen in the following specifications and claims in conjunction with the appended drawings.

THE DRAWINGS

Figure 3:
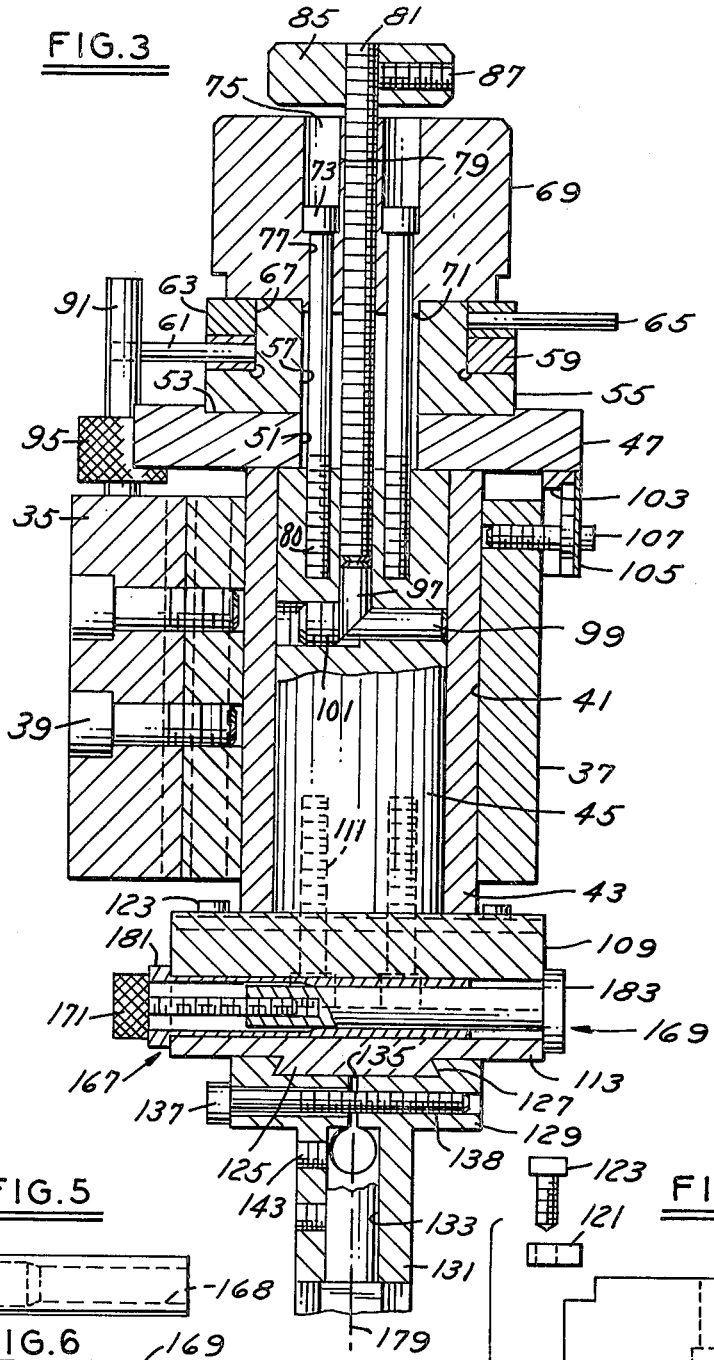
FIG. 3 is a fragmentary vertical section taken in the direction of arrows 3—3, FIG. 2.
Figure 5:
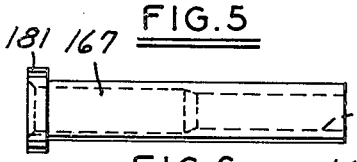
Figure 6:
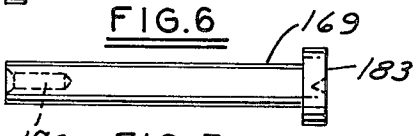
Figure 7:
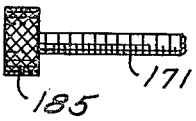

FIGS. 5, 6, and 7 are side views of the adjustable tangent stop screw assembly parts shown in FIG. 3 including respectively the telescoping hollow pin, the tangent pin, and the knurled knob locking screw.

Figure 8:
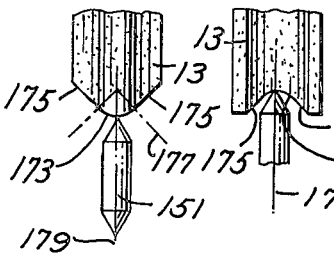

FIG. 8 is a fragmentary illustration of a grinding wheel having a convex periphery including a radius and tangent angle surfaces.

Figure 9:
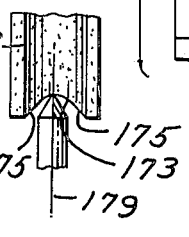

FIG. 9 is a similar view of a grinding wheel having a concave surface including a radius and tangential angles adapted for dressing by the present radius dresser.

It will be understood that the above drawings are illustrative of one embodiment of the invention, and that other embodiments are contemplated within the scope of the claims hereafter set forth.

DETAILED DESCRIPTION OF AN EMBODIMENT OF THE INVENTION

Figure 1:
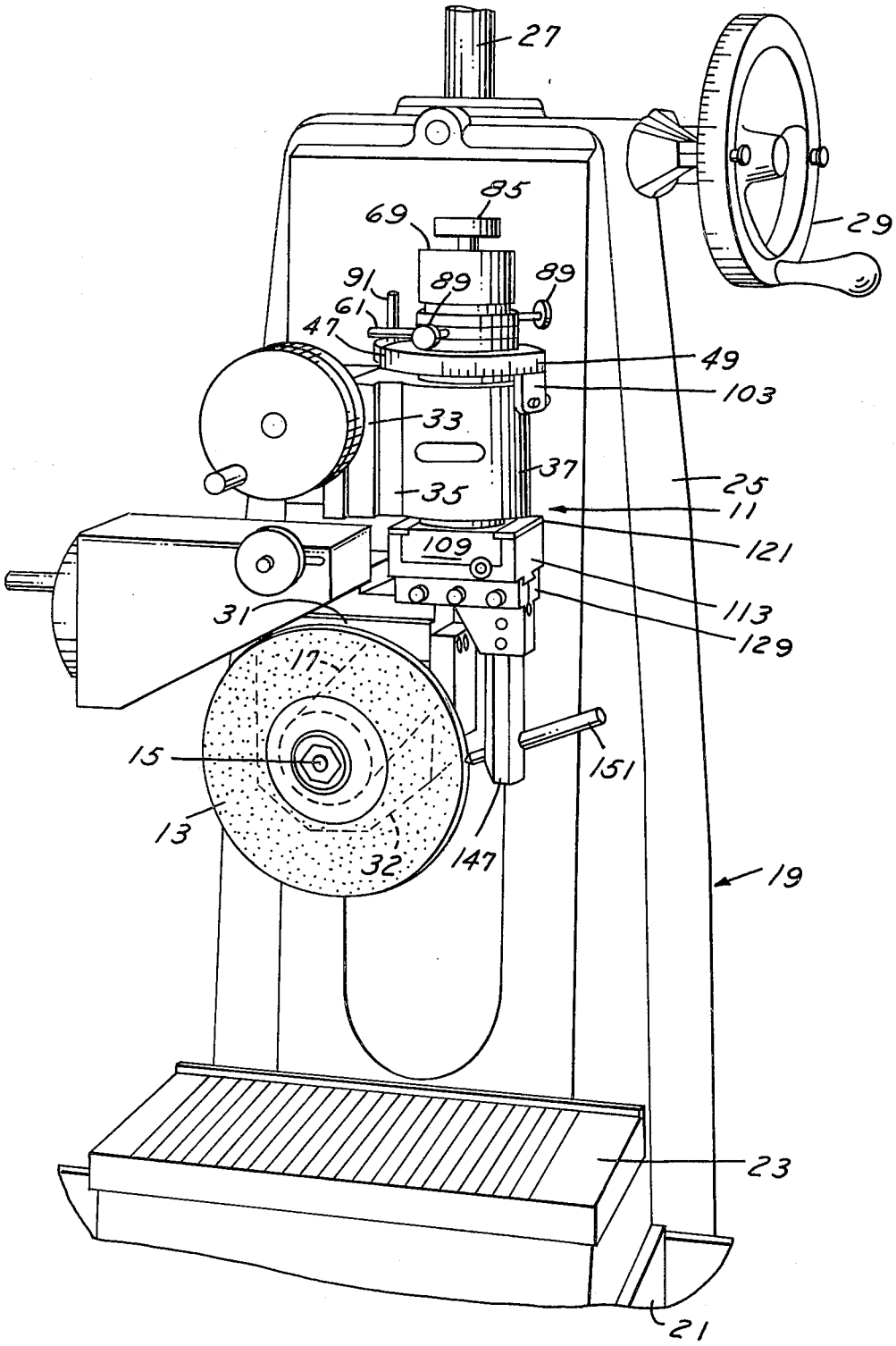
FIG. 1 is a fragmentary front perspective view of a surface grinder and its grinding wheel on which the present overhead dresser is supportably mounted.

Referring to FIG. 1 of the drawings, the present overhead radius dresser for grinding wheels is designated at 11 and is adapted for registry with a conventional abrasive grinding wheel 13 having a convex or concave periphery, such as fragmentarily shown in FIGS. 8 and 9. The grinding wheel 13 is mounted upon drive shaft 15 having a first axis and is journaled upon spindle 17 of a conventional surface grinder 19, fragmentarily shown.

The grinder 19 has a base 21 and a workpiece support bed 23 and an upright conventional standard 25. Surface grinder 19 includes spindle adjustment shaft 27 controlled by hand wheel 29 for adjusting the spindle 17 and shaft 15 virtually (up or down) as desired for setting the height of the abrasive grinding wheel 13.

The present overhead radius dresser includes a base 31, shown in FIG. 1, which includes a depending spindle bracket or yoke 32 mountable upon spindle 17 and affixed thereto. Upright mount plate 33 upon base 31 is suitably secured to the main housing base 35, in turn secured by fasteners 39, FIG. 3 to the main cylindrical housing 37.

The housing 37 has a cylindrical bore 41 in FIG. 3 within which is positioned and secured the upright bushing 43 within which is rotatably mounted the main shaft 45 having an axis referred as the second axis 132. The rotating degree disc 47 having indicia 49 thereon in degrees as between 0 and 90 degrees upon opposite sides of a central position in FIGS. 1 and 2 and has an axial bore 51 and upon the top thereof circular recess 53.

The annular stop ring flange 55 having an axial bore 57 is axially positioned upon rotating degree disc 47 within the recess 53 therein and supportably mounts a pair of stacked stop slip rings 59 and 63 whose axial bores 67 are in sliding registry with portions of the stop ring flange and adapted for rotary adjustment thereon.

Each of the stop slip rings have secured thereto a radial stop rod 61, 65. The radial rods 61 and 65 in the initial set up are normally spaced upon opposite sides of a central or zero portion with respect to the rotating degree disc 47.

Rotation knob 69 at its lower end has a depending annular shoulder 71 which is nested within bore 57 of the stop ring flange 55 and is secured to the main shaft 45 by a pair of elongated headed fasteners 73. These retainingly bear against internal shoulders at the end of the bores 75 and extend through the counter bores 77 in the knob 69, through the bore 57 of the stop ring flange 55 and at their lower ends are threaded into corresponding threaded apertures 80 at the upper end of the main shaft 45.

The fasteners 73 are sufficiently tightened so that the rotation knob 69 is axially mounted in compression with respect to stop ring flange 55 and the rotating degree disc 47 and the rotatable main shaft 45.

Threaded rod 81 is journaled through bore 79 of said rotation knob and extends through the stop ring flange 55 and is adjustably threaded into the threaded bore 83 axial of main shaft 45. A knurled knob 85 is spaced above rotation knob 69, FIG. 3, and is secured to the outer end of rod 81 as by the set screw 87.

Figure 2:
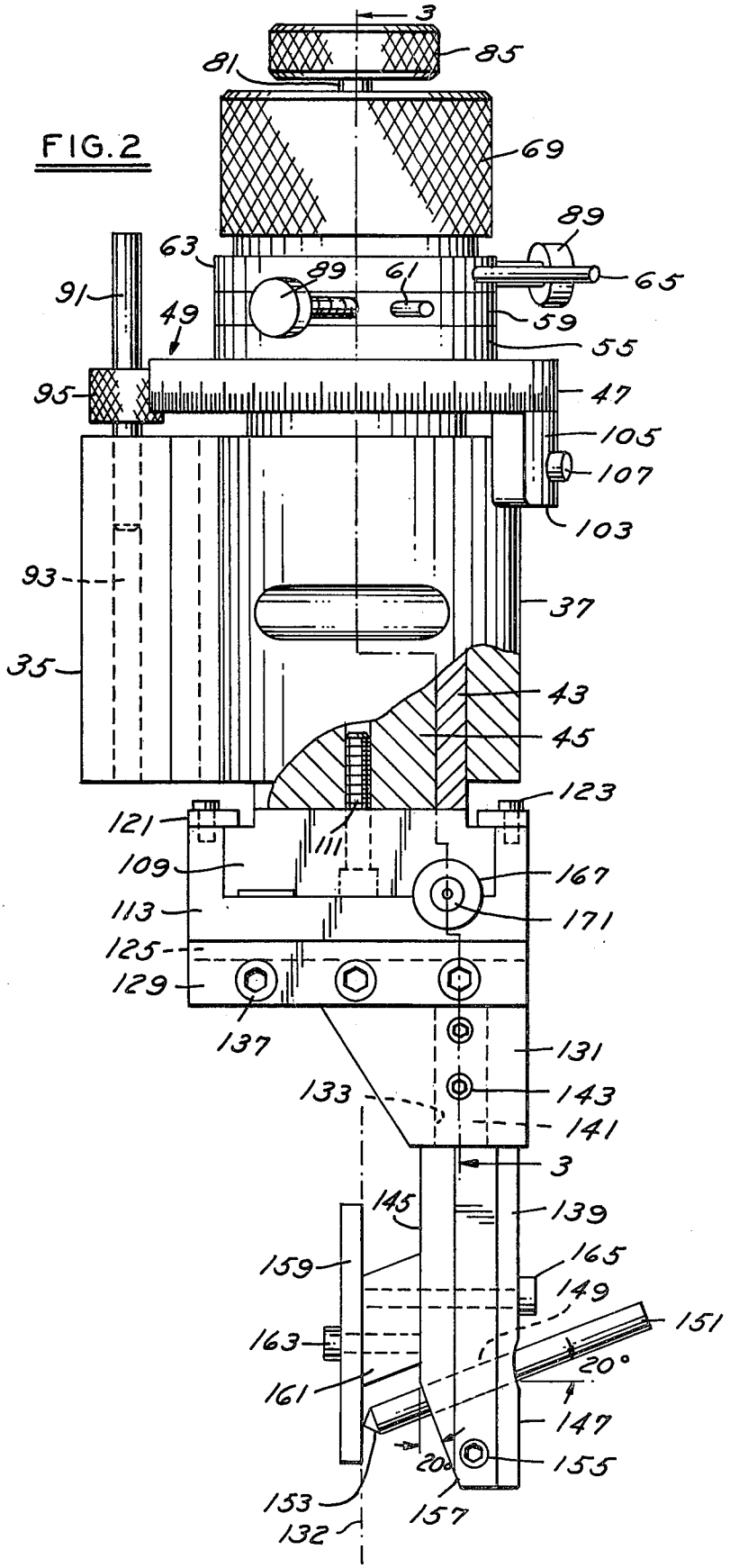
FIG. 2 is a front elevational view of the present overhead dresser shown in FIG. 1, on an increased scale and partly broken away and sectioned.

The respective stop slip rings 59 and 63 are rotatably adjustable upon stop ring flange 55 and are secured in a predetermined angular position by the set screw lock knobs 89, FIGS. 1 and 2, which frictionally engage stop ring flange 55. Sometimes stop rods 61 and 65 are equally spaced apart from a neutral or central position with respect to the degree indicia such as the zero location upon the degree dial of disc 47. It is contemplated, however, that the rings 59 and 63 will be rotated to a different angular position when there is a non-uniformity in the angles on the grinding wheel 13 to be dressed.

Once the rings 59 and 63 have been rotatively set and secured upon the respective rings, any subsequent rotation of the knob 69 will affect the corresponding rotation of the rings and the stop ring flange 55 upon which they are mounted. An upright stop pin 91 is removably positioned within bore 93, FIG. 2, of the main housing base 35, and intermediate its ends mounts the knurled hub 95.

The stop pin 91 is arranged so as to be normally in the path of rotating movement of the respective stop rods 61 and 65 to limit alternate rotary movements of the main shaft 45 to the preset extreme positions of rotary adjustment for the diamond tool. This is for dressing the radius 173 of the grinding wheel 13 shown in FIG. 8, or the concave radius 173 shown in FIG. 9.

A 45° wedge pin 97 is loosely positioned within bore 83 of the main shaft 45 and at its lower end has a 45° inclined surface adapted for operative engagement with a corresponding 45° inclined surface upon the radially disposed wedge pin 99 positioned within a corresponding and communicating radial recess within main shaft 45.

Adjustable back-up set screw 101 is threaded into a radial bore within the main shaft 45 in axial registry with wedge pin 99 and is normally positioned to act as a back up for the upright wedge pin 97 when it is advanced downwardly to engagement with the radial wedge pin 99 upon rotation of the shaft 81 which is threaded into the bore 83 of the main shaft 45.

When the wedge pin 97 is in operative engagement with the wedge pin 99, wedge pin 99 moves radially outward into frictional operative engagement with the bushing 43 for securing the main shaft 45 in any preselected angular position of rotary adjustment.

Mounted upon the upper side of the main housing 37 is the arcuate scale mount 103 having a Vernier scale 105 showing fifteen minute separations. Mount 103 is secured to the main housing by the fasteners 107, FIGS. 2 and 3. Vernier scale 105 is closely adjacent the periphery of the rotating degree disc 47 and in registry with its scale 49, setting the central zero location or central position with respect to which rotating degree disc 47 can rotate in opposite directions.

Figure 4:
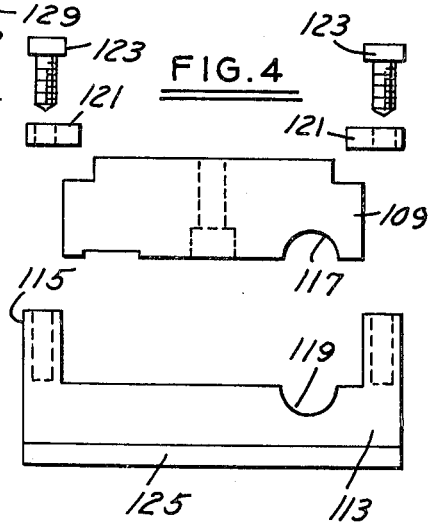
FIG. 4 is an exploded view of the slide plate and slide plate housing shown in FIGS. 2 and 3.

Transverse slide plate 109 extends across the lower end of the main shaft 45 and is secured thereto by a pair of fasteners 111. The slide plate 109 has a central axis which is the same axis as the second axis 132 of the main shaft 45 and which is coincident with the plane of the grinding wheel 13 such as shown in FIG. 1. It also has a transverse axis which is parallel to the first axis or axis of rotation of grinding wheel 13. U-shaped slide housing 113 has a pair of upright end walls 115, FIG. 4 between which slide plate 109 is positioned. Slide plate 109 has a transverse semi-cylindrical recess 117 in its undersurface in cooperative registry with a corresponding semi-cylindrical recess 119 in the upper surface of slide housing 113. Transverse slide straps 121 are secured to the top portions of the respective end walls 115 of the slide housing 113 as by fasteners 123 and extend inwardly for supported engagement upon corresponding upper surfaces of the slide plate 109, such as shown in FIG. 1. By this construction, the slide housing 113, normally mounted and supported upon the slide plate 109, is adapted to move transversely across the central axis of the slide plate 109 to result in a corresponding transverse movement of the diamond tool 151 as hereinafter described.

The undersurface of the slide housing 113 has a radially extending dove tail 125 which is nested within a corresponding dove tail groove 127 within the slide arm 129. Thus, the slide arm 129 is adapted for longitudinal adjustments with respect to the slide housing 113.

The slide arm 129 adjacent one end has a depending holder 131 laterally displaced from the centerline 132 which corresponds to the second axis or axis of rotation of the main shaft 45. The holder 131 has an upright bore 133 which at its end terminates in a split portion 135 adjacent the dove tail groove 127. Transverse socket headed caps screws 137 extend through corresponding bores 138 of slide arm 129 and into corresponding aligned threaded bores therein drawing up and securing the split portions of the slide arm 129 in any preselected radial position of adjustment for setting the radius of rotation for the diamond tool 151, 153.

Upright diamond holder arm 139 at its upper end has a cylindrical shank 141 which is projected up into and secured within bore 133 of the holder 131 and secured thereto by the set screws 143, FIG. 2. The diamond holder arm 139 upon one side has a flat face 145 and has a centrally split portion 147 at its lower end and adjacent thereto angular bore 149, which in the illustrative embodiment is set at 20° to the horizontal.

The similarly inclined diamond tool 151 mounting a diamond head 153 at one end extends through the angular bore 149 of the diamond holder arm 139 and is adjusted and secured in position by the assembly screw 155.

The lower end of the diamond holder arm 139 on the side corresponding to the flat face 145 has a tapered clearance face 157 which extends in the illustrative embodiment, and an example, at a 20° angle to the face 145, so that the diamond tool 151 normally extends at right angles to the tapered clearance face 157. In some cases well known in the art, the tool 151 may be mounted horizontally for forming very small radiuses.

As arranged in FIG. 2, the diamond head 153 is in registry with the second axis or axis of rotation 132 of the main shaft 45 for the proper dressing of the grinding wheel 13 in the relationship shown in FIGS. 8 and 9.

In order to assure that the diamond head 153 is arranged exactly at the center of rotation 132 or second axis, there is employed a set block cap 159 which has secured upon one side thereof as by fastener 163, the set block 161 whose top and bottom surfaces are inclined so as to be parallel to the diamond tool 151.

Fastener 165 extends through the diamond holder arm 147 and into the set block 161 fixedly securing the set block cap 159 with respect to the diamond holder arm, so that one upright surface thereof exactly registers with and corresponds to the second axis 132, being the axis of rotation of the main shaft 45. With this arrangement, the diamond tool 151 is adjustably positioned with respect to the diamond holder arm 139 until the diamond head 153 engages one surface of the set block cap 159. After this, the fastener 165 is removed and the set block cap 159 removed with the assurance that the diamond head 153 is coincident with the second axis 132 corresponding to the center of rotation of the main shaft 45.

Referring to the drawings, FIGS. 3 through 7 nested within the semi-cylindrical recesses 117, 119 between slide plate 109 and slide housing 113, there is provided a tangent pin assembly shown at 167, 169 and 171 separately in FIGS. 5, 6 and 7 respectively.

As above described, the slide plate 109 has a normal central axis which is in registry with the plane of the grinding wheel 13 and also has a transverse axis which is parallel to the axis of rotation of the grinding wheel sometimes referred to as the first axis.

As shown in FIG. 1 for normal radius dressing only, slide housing 113 is in registry with the slide plate 109. The slide housing 113 is slidably mounted upon the slide plate 109 by the slide straps 121, so that the slide plate 109 is adapted, as desired, for movement along the transverse axis. This transverse movement is under the control of and can be stopped by the tangent pin assembly at the tangent point.

The hollow pin 167, FIGS. 3 and 5 is slidably positioned within the bore defined by the recess 117 and 119 within the slide plate 109 and the slide housing 113 extending from one end of the assembly shown in FIG. 3. Pin 167 has a longitudinal bore 168, FIG. 5 and is adapted to telescopingly receive elongated tangent pin 169, FIG. 6, which at one end has a axial threaded bore 170.

Hollow pin 167 has a head 181 adapted for registry with the common or corresponding side walls of the slide plate 109 and the slide housing 113. The corresponding tangent pin 169 at one end has a head 183 which is adapted to engage the corresponding opposite side walls of slide plate 109 and slide housing 113.

Knurled knob screw 171 extends through one end of the hollow pin 167 and is threaded into the axial bore 170 of the tangent pin and is adapted to lock the relative telescoping movement between hollow pin 167 and tangent pin 169.

In the illustration of the assembled pins in FIG. 3, the corresponding heads 181 and 183 are held by the screw 171 against opposite sides of the respective slide plate 109 and the slide housing 113. This arrangement corresponds to a "centerline holding position" wherein the slide housing 113 cannot move transversely with respect to the slide plate 109. In this situation, the diamond tool is employed merely for dressing the radius of the grinding wheel, convex or concave as shown at 173, FIGS. 8 and 9.

Schematically the diamond tool is shown at 151 as in registry with the radius 173 of the respective grinding wheel 13 whether it be convex or concave so that upon manual rotation of the knob 69 in one direction or the other as limited by rods 61 and 65 merely the radius will be dressed on the grinding wheel.

With the screw 171 removed, the pins 169 and 167 are adapted for telescoping relative movement with respect to each other. As an example and as illustrated, the pins are of equal length.

This means that under some conditions when it is desired to dress the tangential angles 175 of the grinding wheel 13 such as in FIGS. 8 and 9, after there has been a rotary sweep of the diamond tool head 151, at the end of the radius upon one side thereof, there may be an additional lateral sweep of the tool in a rectilinear direction which corresponds to the transverse movement of the slide housing 113. Thus the diamond tool 151 will translate over the tangential angle 175 of the grinding wheel 13 and will be stopped by the corresponding heads 181 or 183 of the respective hollow pin 167 or tangent pin 169.

OPERATION

The present telescopic stop pins 167, 169 are used for centerline holding as in FIG. 3 and for tangent point stopping of the diamond holder slide housing 113.

The transverse movement of the slide housing 113 sweeps an angular surface outwardly from the tangent point of the radius by releasing the slide housing 113 from the central tangent point after the radius has been dressed. The respective pins and their heads 181 or 183 telescope outwardly an are carried along with the housing as it sweeps the diamond head 153 to the edge of the grinding wheel 13.

When dressing an angle toward a radius, the ability to stop at the tangent point before swinging the radius is accomplished by squeezing or holding the pins together at the head end thereof at 181 and 183 with the thumb and index finger.

The centerline holding is accomplished by locking the pins together such as shown in FIG. 3 with the head 185 of the screw 171 in engagement with the hollow pin head 181, FIG. 3. The centerline hold is used when there is desired no sweeping action as would be required for tangential dressing of the two angles 175 outwardly of the corresponding radius as at 173, FIG. 8. There are times, however, when only the radius is needed to be dressed as at 173, FIGS. 8 and 9 and the centerline is fixed by the arrangement shown in FIG. 3. The present radius dresser is particularly adapted to work when vertically mounted, such as shown in FIG. 1.

Accordingly, the present invention provides for a combined centerline holding and tangential stopping with the slide housing for tangential dressing of the outer angles of the grinding wheel 13.

The telescoping pins 167 and 169 are of equal length, one within the other to prevent one pin from falling off the housing 113 during the sliding operation.

The slide arm 129 which carries the diamond 153 and diamond tool 151 as in FIG. 2, is also adjustable to set the radius to which the diamond will sweep. This is accomplished by loosening the fasteners 137 and adjusting the slide arm 129 radially inwardly or outwardly as desired. Thus, by adjustment of the slide arm 129, the diamond tool 151 may dress a male or female radius on the grinding wheel 13. In the position of the diamond tool 151 shown in FIG. 2, the tool 151 will dress a zero size radius and when the holder 131 is moved to the left of that position the tool 151 is adapted to dress a female radius, such as shown in FIG. 9. When the holder 131 is moved to the right of the position shown FIG. 2, the diamond tool 151 will dress a male radius, as shown in FIG. 8.

In operation, slide housing 113 is movable transversely of the slide plate 109 and must always be returned to registry with the centerline or central axis of the slide plate 109 as shown at 179 for swinging the radius 173. When you swing the radius, you must start at the center 179 and the tool 151 is maintained on center.

When you sweep the angles 175, FIGS. 8 and 9, you move off the centerline 179 and after the angle is formed, you must go back to the centerline 179 for swinging the radius 173. The degree of angle sweep for tangent dressing is set by the stop pins 61 and 65.

After each swing of the radius 173 as designated by the arc 177, FIG. 8, you sweep the tangential lines 175 corresponding to the angles 175 upon the grinding wheel 13.

When you swing the radius 173, and you also sweep the angles 175, the respective pins 167, 169 are held together with the fingers during swinging of the radius in order to maintain the center 179. Thereafter the fingers are removed from the stop pins or tangent pins 167, 169 to sweep one angle from the tangent point out. This sweep is accomplished simply by pushing the slide housing 113 in the needed direction using the thumb or fingers. Then in order to sweep back to the center 179, FIG. 8, you squeeze the telescopic pins together with the thumb and fingers. You will hold the telescopic pins 167, 169 together while swinging the radius to the other tangent point and then remove the fingers from the pins and sweep the other angle of the grinding wheel 13.

Having described my invention, reference should now be had to the following claims:

I claim:

1. An overhead radius dresser for a grinding wheel for surface grinding or the like, with the grinding wheel being rotatable upon a first axis and having a spindle, said overhead radius dresser comprising;

a main housing having a cylindrical bore mounted upon said spindle;

a manually rotatable main shaft journaled within said housing reciprocally rotatable upon a second axis at right angles to and spaced from said first axis;

a slide plate at right angles to and mounted upon said shaft having the same axis as said second axis and also having a transverse axis parallel to said first axis;

a slide housing mounted upon and in registry with said slide plate and said second axis and adapted to travel along said transverse axis and said slide plate in opposite directions across said second axis;

a slide arm mounted upon and depending from said slide housing for longitudinal adjustments towards and away from said second axis;

a diamond holder arm secured to and depending from said slide arm;

a diamond tool adjustably mounted upon and extending transversely of said holder arm having a diamond head in registry with said second axis of rotation adapted for operative engagement with the grinding wheel during rotation thereof;

manual reciprocal rotation of said main shaft over a predetermined arc from a central position adapted to dress a corresponding radius in the grinding wheel periphery;

said slide housing remaining in registry with said slide plate and said second axis during selective rotation of said main shaft in both directions relative to said central position for normal radius dressing of the grinding wheel;

said slide housing being adapted for lateral movement relative to said slide plate along said transverse axis, after the main shaft is fully rotated in one direction from said central position, said diamond head moving tangentially from its initial arc of rotation for tangentially dressing the flat outer angle of the grinding wheel;

and stop screw means including a pair of reciprocally movable pins mounted upon and interposed between said slide plate and slide housing to facilitate stopping at the second axis and adapted to retainingly engage said slide housing against travel along said transverse axis relative to said slide plate;

and further adapted to selectively facilitate said travel for tangential surface dressing of tangential angles of the grinding wheel;

said stop screw means including an elongated tangent pin extending transversely between said slide plate and slide housing having a head adapted to engage the corresponding one sides of said slide plate and slide housing;

an oppositely directed hollow pin extending between said slide plate and slide housing guidably receiving said tangent pin and having a head adapted to engage the corresponding other sides of said slide plate and slide housing;

and a screw extending axially into said hollow pin and threaded into said tangent pin, and having a head normally tight against said hollow pinhead, said tangent pin adapted for reciprocal movements relative to said hollow pin when said screw is removed.

2. In the radius dresser of claim 1, said slide housing being U-shaped including spaced end walls receiving the ends of said slide plate;

and slide straps mounted upon and secured to said end walls and supportably and loosely overlying said slide plate.

3. In the radius dresser 1, said tangent pin and hollow pin being of equal length.

4. In the radius dresser of claim 1, an upright set block cap;

a spacer set block parallel to said diamond tool, on one upright end secured to said set block cap;

its other end bearing against said diamond holder arm and removably secured thereto;

one face of said set block cap being in registry with said second axis;

said diamond tool head extending into registry with said set block cap to verify that said diamond head location is at the center of rotation of said main shaft.

5. An overhead radius dresser for a grinding wheel for surface grinders or the like, with the grinding wheel being rotatable upon a first axis and having a spindle, said overhead radius dresser comprising;

a main housing having a cylindrical bore mounted upon said spindle;

a manually rotatable main shaft journaled within said housing reciprocally rotatable upon a second axis at right angles to and spaced from said first axis;

a slide plate at right angles to and mounted upon said shaft having the same axis as said second axis and also having a transverse axis parallel to said first axis;

a slide housing mounted upon and in registry with said slide plate and said second axis and adapted to travel along said transverse axis and said slide plate in opposite directions across said second axis;

a slide arm mounted upon and depending from said slide housing for longitudinal adjustments towards and away from said second axis;

a diamond holder arm secured to and depending from said slide arm;

a diamond tool adjustably mounted upon and extending transversely of said holder arm having a diamond head in registry with said second axis of rotation adapted for operative engagement with the grinding wheel during rotation thereof;

manual reciprocal rotation of said main shaft over a predetermined arc from a central position adapted to dress a corresponding radius in the grinding wheel periphery;

said slide housing remaining in registry with said slide plate and said second axis during selective rotation of said main shaft in both directions relative to said central position for normal radius dressing of the grinding wheel;

said slide housing being adapted for lateral movement relative to said slide plate along said transverse axis, after the main shaft is fully rotated in one direction from said central position, said diamond head moving tangentially from its intial arc of rotation for tangentially dressing the flat outer angle of the grinding wheel;

and stop screw means including a pair of reciprocally movable pins mounted upon and interposed between said slide plate and slide housing to facilitate stopping at the second axis and adapted to retaininingly engage said slide housing against travel along said transverse axis relative to said slide plate;

and further adapted to selectively facilitate said travel for tangential surface dressing of tangential angles of the grinding wheel;

said main shaft having a threaded axial bore;

a bushing secured within said housing receiving said main shaft;

a radially adjustable wedge pin mounted within said main shaft at one end adapted for frictional retaining engagement with said bushing;

its other end having a 45° wedge surface extending into said axial bore;

a second wedge pin within said axial bore having a 45° wedge surface at one end in registry with the wedge surface of said first wedge pin;

and a manually rotatable screw threaded into said axial bore;

and its inner end adapted to operatively engage and move said second wedge pin into engagement with and move said first wedge pin securing said main shaft against rotation within said bushing.

6. In the radius dresser of claim 5, a radially adjustable back-up set screw aligned with and spaced from said first wedge pin and extending to said axial bore for laterally supporting said second wedge pin when advanced for operative engagement with said first wedge pin.

* * * * *